United States Patent [19]

Sterling, Jr. et al.

[11] Patent Number: 4,604,566

[45] Date of Patent: Aug. 5, 1986

[54] VOLTAGE PULSE TO CURRENT REGULATING CONVERTOR

[75] Inventors: Edward L. Sterling, Jr., Cleveland; Edward Bastijanic, Concord, both of Ohio

[73] Assignee: The Babcock & Wilcox Company, New Orleans, La.

[21] Appl. No.: 763,486

[22] Filed: Aug. 7, 1985

[51] Int. Cl.[4] ..... G05F 1/58; G08C 19/02

[52] U.S. Cl. ..... 323/275; 323/280; 340/870.39; 340/870.42

[58] Field of Search ..... 323/273, 274, 275, 280, 323/281, 349; 340/870.38, 870.39, 870.42, 870.43; 455/117, 127

[56] References Cited

U.S. PATENT DOCUMENTS 4,250,490 2/1981 Dahlke ..... 340/870.39
4,481,514 11/1984 Beukers et al. ..... 340/870.38
4,502,003 2/1985 Frick ..... 323/275
4,544,875 10/1985 Park et al. ..... 323/280

*Primary Examiner*—Peter S. Wong
*Attorney, Agent, or Firm*—Vytas R. Matas; Robert J. Edwards

[57] ABSTRACT

A current regulating convertor includes a pulse generator which generates a voltage pulse train having a variable duty cycle. A low pass filter is connected to receive the pulse train and has a cutoff frequency which is well below the frequency of the pulse train. The low pass filter generates a D/C voltage signal which has a voltage level that is proportional to the duty cycle of the pulse train. The D/C signal is used in a circuit that draws a current from a power supply which is proportional to the voltage level of the D/C signal. The power supply is connected to the circuit by a 4–20 mA currrent loop.

14 Claims, 5 Drawing Figures

VOLTAGE PULSE TO CURRENT REGULATING CONVERTOR6

FIELD AND BACKGROUND OF THE INVENTION

The present invention relates in general to digital-to-current convertors, and in particular to a new and useful voltage pulse to current regulating convertor which is capable of converting digital information for example from a microprocessor, into analog information which can be supplied for example to a two-wire 4–20 mA transmission system.

Two-wire analog transmission systems are well known. Such systems include a transmitter which is connected to a power supply by two wires which form a current loop. The transmitter includes, as at least one of its features, a transducer which senses a condition such as pressure or temperature. This condition is known as a process variable (PV).

A power supply is connected to the two wires to close the current loop. It is also conventional to provide a resistor in the current loop. The transmitter amplifies the signal from its transducer and this amplified signal is used to draw a certain current from the power supply which is proportional or otherwise related to the process variable. It is conventional to draw from a minimum of 4 (mA) to a maximum of 20 mA. The current between 4 and 20 mA passes through the resistor to produce a voltage drop across the resistor. This voltage drop can be measured to give a value for the process variable.

It is noted that the 4 mA minimum current is required to energize the circuitry of the transmitter. Any excess current above this 4 mA level is taken as a value which can be used to determine the process variable.

It is known that such 4–20 mA two-wire systems have an accuracy which is limited to around 0.1% at best. These systems are also essentially unidirectional with the transmitter being essentially uncontrolled and transmitting continuously.

SUMMARY OF THE INVENTION

The present invention permits the use of microprocessor technology to improve the overall accuracy and expand the functionality of two-wire analog transmission systems.

According to the invention a method and apparatus is provided for interfacing the microprocessor with the current loop of the analog transmission system.

An object of the present invention is thus to provide a voltage pulse to current regulating convertor which comprises pulse generator means for generating a voltage pulse having a selected frequency and a variable duty cycle, a low pass filter connected to said pulse generator means for receiving said voltage pulse and for generating a voltage level which corresponds to the duty cycle of the voltage pulse, the low pass filter having a cutoff frequency which is less than said selected frequency, and current drawing means connected to said low pass filter for drawing a current which is proportional to the voltage level.

A further object of the invention is to provide a method of converting voltage pulse information into an analog current comprising generating a voltage pulse having a selected frequency and a variable duty cycle, subjecting the voltage pulse to low pass filtering with a low pass filter having a cutoff frequency below the selected frequency to generate a substantially constant voltage level which corresponds to the duty cycle of the voltage pulse, and drawing a current which is proportional to the voltage level.

A still further object of the invention is to provide a digital to analog converting circuit which utilizes microprocessor technology and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
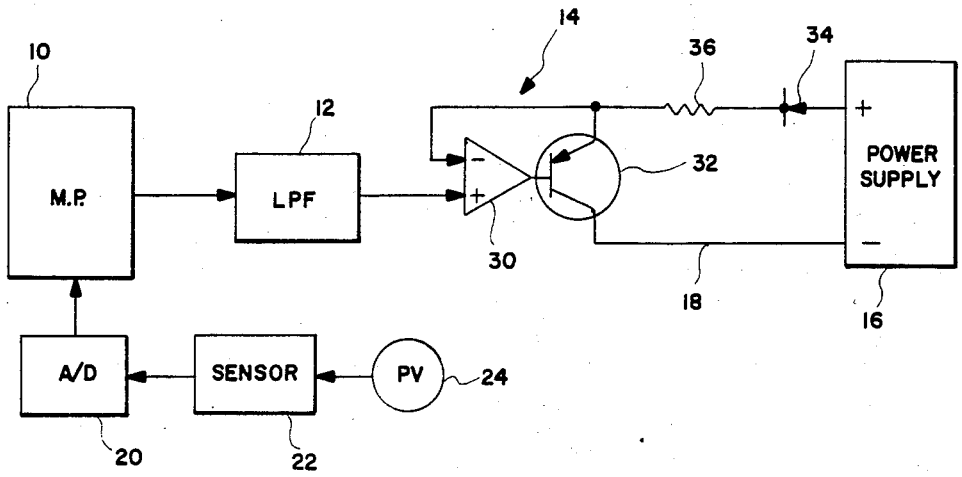
FIG. 1 is a schematic and block diagram of a circuit constructed and used in accordance with the invention.

Referring to the drawings in particular, the invention embodied in FIG. 1 comprises a voltage pulse to current regulating convertor which includes a microprocessor 10, a low pass filter 12 connected to an output of the microprocessor 10, a loop current regulating circuit 14 connected to an output of the low pass filter 12, and a power supply 16 which supplies power to a current loop 18 depending on the current drawn by circuit 14.

Figure 2:
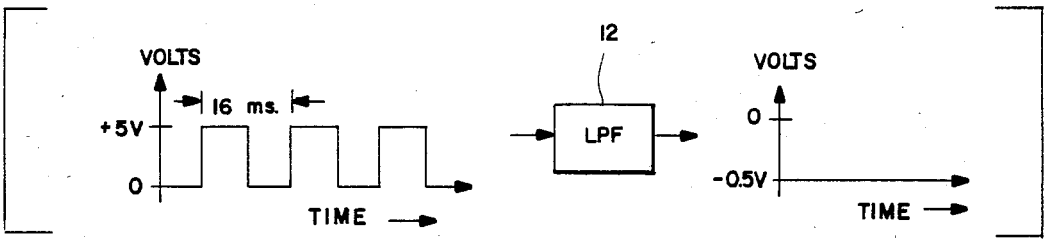
FIG. 2 is a graphic illustration showing how a variable duty cycle voltage pulse is converted to a steady voltage level which is proportional to the duty cycle of the pulse.

Microprocessor 10 has an input connected to an analog-to-digital convertor 20 which can be of conventional design. A/D 20 has an input connected to transducer or sensor 22 which receives a process variable 24, such as pressure or temperature. Microprocessor 10 is programmed to generate a variable duty cycle voltage pulse such as that illustrated in FIG. 2. The pulses have a period 16 (ms). The duty cycle of the pulse shown in FIG. 2 is such that positive 5 volts is generated for about half the pulse duration, 0 volts being generated for the second half of the pulse duration.

Figure 3:
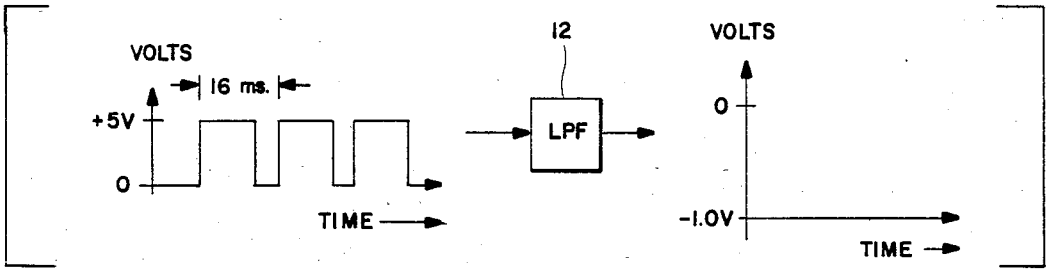
FIG. 3 is a view similar to FIG. 2 showing the effect of widening the voltage pulse to change its duty cycle.
Figure 4:
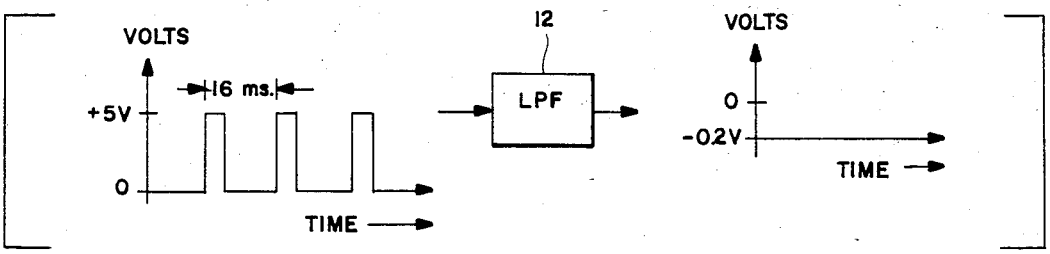
FIG. 4 is a view similar to FIG. 3 showing the effect which results by narrowing the pulse to vary the duty cycle.

FIGS. 3 and 4 show voltage pulses which also have durations of 16 ms per cycle. but with different duty cycles.

Examples of known microprocessors which can be used as microprocessor are the Motorola Model 68HC11 or Model 68HC05-C4.

Sensor or transducer 22 may be of the known type for measuring differential pressure. An example of this is a thin film strain gauge.

A known analog-to-digital convertor which can be used as A/D 20 is the National ADC 1001.

Low pass filter 12 can also be of known design and may for example be a Second Order Bessel Filter.

Current loop 18 forms the two-wire 4–20 mA loop. Power supply 16 is of known design and may for example be a 12–42 VDC power supply.

As shown in FIGS. 2 through 4, depending on the duty cycle of the variable duty cycle voltage pulse supplied by microprocessor 10, low pass filter 12 generates a voltage level, in this case negative voltages, which is proportional to or corresponds to the duty cycle of the voltage pulse. Low pass filter 12 is selected to have a cutoff frequency which is well below the frequency of the voltage pulses generated by microprocessor 10. A cutoff frequency of 1 Hz has been found useful for the voltage pulses having a 16 ms pulse width.

As shown in FIG. 2, a duty cycle where the higher voltage level is present for about half the pulse width generates a voltage of about −0.5 volts. Pulses having a longer duty cycle as shown in FIG. 3 may generate a voltage of −1.0 volts whereas a much shorter duty cycle as shown in FIG. 4 generates a much lower voltage of −0.2 volts.

Loop current regulating circuit 14 comprises a differential amplifier 30 which receives the D.C. voltage from low pass filter 12 at its positive terminal. The output of amplifier 30 is connected to the base of a transistor 32 for turning transistor 32 on by an amount which is proportional to the voltage level from low pass filter 12. The emitter of PNP transistor 32, is connected in a feedback loop to the negative input of amplifier 30 so that the voltage at the emitter is equal to the voltage from the output of low pass filter 12 to the positive input of amplifier 30. The positive terminal of power supply 16 is connected in series with a diode 34 and a resistor 36 to the emitter of transistor 32. The collector of transistor 32 is connected to the negative terminal of power supply 16.

The voltage appearing at the positive input of amplifier 30 and the emitter of transistor 32 will determine the amount of current which will be drawn from power supply 16 and which will pass through the transistor 32 and thus through the current loop 18. This will be a current from 4 to 20 mA.

With the cutoff frequency of low pass filter 12 being 1 Hz, filter 12 outputs −0.2 volts at 4 mA on current loop 18 and −1.0 volts at 20 mA on current loop 18.

The invention substantially improves the accuracy at which current is drawn from power supply 16.

Figure 5:
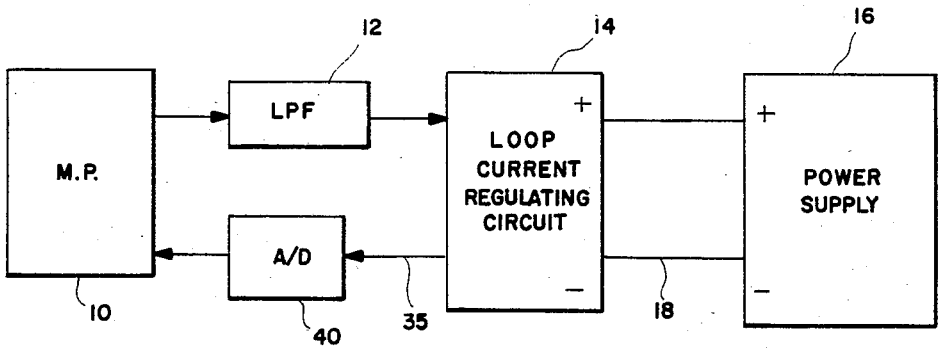
FIG. 5 is a block diagram showing another embodiment of the invention having a feedback loop.

Even greater accuracy is possible in the embodiment shown in FIG. 5. In FIG. 5 the same reference numerals are utilized to designate the same or similar elements.

The loop current regulating circuit 14 is provided with an extra output at 35 which carries the same current as appears on loop 18. This current is applied to analog-to-digital convertor 40 which may be similar to A/D 20 in FIG. 1. A/D 40 outputs a digital signal which is supplied to microprocessor 10 to modify the duty cycle of the voltage pulse being applied to low pass filter 12.

The establishment of a feedback loop for the microprocessor permits a very exact control over the current in current loop 18. This is particularly useful in avoiding a drift in the circuitry which is caused by changes in temperature. Although known techniques can be followed in designing the circuitry used in the components in the present invention, to reduce drift to a minimum, some temperature related drift will still take place. By supplying a feedback pathway through the A/D 40, microprocessor 10 can receive an accurate reading (in digital form) for the current in current loop 18, and appropriate corrections can be made in the duty cycle of the voltage pulse being supplied from microprocessor 10 to low pass filter 12.

If for example it is desired to adjust the current in loop 18 to equal exactly 15 mA, microprocessor 10 produces voltage pulses having an appropriate duty cycle and supplies these pulses to low pass filter 12. This produces the appropriate voltage level from the output of filter 12 which is processed in circuit 14 to draw 15 mA of current from power supply 16. If the current starts to drift from 15 mA, the change in current is reflected in the digital signal fr analog-to-digital convertor 40. Microprocessor 10 can then read this digital signal and make appropriate corrections to the duty cycle of the pulses being supplied to low pass filter 12 until the 15 mA value is again reached in current loop 18.

While specific embodiments of the invention have been shown and described in detail to illustrate the application of the principles of the invention, it will be understood that the invention may be embodied otherwise without departing from such principles.

What is claimed is:

1. A voltage pulse to current regulating convertor comprising:

pulse generator means for generating a voltage pulse train having a selected frequency and a variable duty cycle;

a low pass filter connected to said pulse generator means for receiving said voltage pulse train and for generating a D/C voltage level which corresponds to the duty cycle of said voltage pulse train, said low pass filter having a cutoff frequency which is less than said selected frequency; and current drawing means connected to said low pass filter for drawing a current which is proportional to the D/C voltage level.

2. A convertor according to claim 1, wherein said pulse generator means comprises a microprocessor for generating a voltage pulse train having a fixed selected frequency and a variable duty cycle.

3. A convertor according to claim 1, including a power supply for supplying current from 4 to 20 mA of current, a current loop connected between said power supply and said current drawing means for carrying the current which is drawn by said current drawing means from said power supply.

4. A convertor according to claim 1, wherein said current drawing means comprises a differential amplifier having one input connected to said low pass filter for receiving said D/C voltage level, another input and an output, a transistor having a base connected to said amplifier output, said transistor being connected to said other input of said amplifier and carrying a current thereacross which is proportional to the D/C voltage level.

5. A convertor according to claim 4, including a power supply for supplying from 4 to 20 mA of current, and a current loop connected to said power supply and across an emitter and a collector of said transistor.

6. A convertor according to claim 5, including a diode and a resistor connected in series between said power supply and one of said transistor, emitter and collector.

7. A convertor according to claim 6, wherein said pulse generator means comprises a microprocessor for generating the voltage pulse train at a fixed selected frequency and a variable duty cycle.

8. A convertor according to claim 7, wherein said low pass filter is selected to have a cutoff frequency of about 1 Hz.

9. A convertor according to claim 1, wherein said pulse generator means comprises a microprocessor having an input for receiving a digital signal and for modifying the voltage pulse train according to the digital signal, and an analog-to-digital convertor connected between said current drawing means and said microprocessor to generate said digital signal as a function of current being drawn by said current drawing means.

10. A convertor according to claim 9, wherein said low pass filter has a cutoff frequency of 1 Hz.

11. A method of regulating the current in a current loop comprising:

generating a voltage pulse train having a seleced frequency and a variable duty cycle;

subjecting the voltage pulse train to low pass filtering at a cutoff frequency below said selected frequency to generate a D/C voltage level which is proportional to the duty cycle of the voltage pulse train;

connecting a circuit in the current loop which regulates the amount of current passing through the current loop dependent on a D/C voltage supplied to the circuit; and supplying the D/C voltage level to the circuit for regulating the current on the current loop.

12. A method according to claim 11, including generating the voltage pulse train to have a frequency above 60 Hz and subjecting the voltage pulse train to low pass filtering at a cutoff frequency below 1 Hz.

13. A method according to claim 11, including measuring the current in the current loop, converting the measured current to a digital signal, supplying the digital signal to a microprocessor and utilizing the microprocessor to generate the variable duty cycle voltage pulse train and to modify the duty cycle of the voltage pulse train to change the measured current in the current loop to a desired current.

14. A method according to claim 13, including generating the voltage pulse train to have a frequency above 60 Hz and subjecting the pulse train to low pass filtering at a cutoff frequency below 1 Hz.

* * * * *